US009200871B2

(12) United States Patent
Hexels

(10) Patent No.: US 9,200,871 B2
(45) Date of Patent: Dec. 1, 2015

(54) CARRYING SYSTEM COMPRISING A BALLISTIC BODY ARMOR

(75) Inventor: Gerd Hexels, Nettetal (DE)

(73) Assignee: HEXONIA GMBH, Nettetal (DE)

( * ) Notice: Subject to any disclaimer, the term of this patent is extended or adjusted under 35 U.S.C. 154(b) by 917 days.

(21) Appl. No.: 13/497,951

(22) PCT Filed: Sep. 17, 2010

(86) PCT No.: PCT/EP2010/063738

§ 371 (c)(1),
(2), (4) Date: Apr. 20, 2012

(87) PCT Pub. No.: WO2011/036107

PCT Pub. Date: Mar. 31, 2011

(65) Prior Publication Data

US 2013/0042376 A1 Feb. 21, 2013

(30) Foreign Application Priority Data

Sep. 23, 2009 (DE) ..... 10 2009 042 455

(51) Int. Cl.
*A45F 3/06* (2006.01)
*F41H 1/02* (2006.01)
*A45F 3/10* (2006.01)

(52) U.S. Cl.
CPC .. *F41H 1/02* (2013.01); *A45F 3/06* (2013.01); *A45F 3/10* (2013.01)

(58) Field of Classification Search
CPC ..... F41H 1/00; F41H 1/02
USPC ..... 2/2.5, 463, 311; 224/630, 634, 262
See application file for complete search history.

(56) References Cited

U.S. PATENT DOCUMENTS

| | | | | | |
|---|---|---|---|---|---|
| 4,015,759 | A | * | 4/1977 | Dreissigacker et al. | 224/262 |
| 4,214,685 | A | * | 7/1980 | Pletz | 224/634 |
| 4,303,186 | A | * | 12/1981 | Ollinger, IV | 224/634 |
| 4,318,502 | A | * | 3/1982 | Lowe et al. | 224/153 |
| 4,356,942 | A | * | 11/1982 | Hayes | 224/630 |
| 4,479,595 | A | * | 10/1984 | Opsal | 224/630 |
| 4,911,346 | A | * | 3/1990 | Shallman | 224/631 |
| 4,982,884 | A | * | 1/1991 | Wise | 224/634 |
| 5,005,744 | A | * | 4/1991 | Gleason | 224/630 |
| 5,184,763 | A | * | 2/1993 | Blaisdell et al. | 224/153 |
| 5,449,102 | A | * | 9/1995 | Sason | 224/632 |
| 5,529,229 | A | * | 6/1996 | Fier | 224/153 |
| 5,562,236 | A | * | 10/1996 | Monzingo | 224/153 |
| 5,806,741 | A | * | 9/1998 | Kirk | 224/634 |
| 5,836,489 | A | * | 11/1998 | Swetish | 224/262 |
| 5,954,250 | A | * | 9/1999 | Hall et al. | 224/262 |
| 5,984,157 | A | * | 11/1999 | Swetish | 224/631 |
| 6,179,175 | B1 | * | 1/2001 | Painter | 224/153 |

(Continued)

FOREIGN PATENT DOCUMENTS

| | | | |
|---|---|---|---|
| EP | 1842449 | A1 | 10/2007 |
| EP | 1994841 | A1 | 11/2008 |

(Continued)

*Primary Examiner* — Richale Quinn
(74) *Attorney, Agent, or Firm* — Randall Danskin PS

(57) ABSTRACT

A carrying system with a ballistic protective vest is described, and which includes a front part, and a back part, and a means for attaching the carrying system to a person's upper body; a waist belt having a lateral support; a coupling to releasably attach a carrying means to the rear side of the back part, and wherein the lateral support can be attached to the carrying means.

28 Claims, 11 Drawing Sheets

(56) References Cited

U.S. PATENT DOCUMENTS

| | | | | |
|---|---|---|---|---|
| 6,179,187 | B1 * | 1/2001 | Lemire et al. | 224/640 |
| 6,536,641 | B1 * | 3/2003 | Sundara et al. | 224/637 |
| 6,722,543 | B1 * | 4/2004 | Fitzgerald et al. | 224/583 |
| D516,777 | S * | 3/2006 | Beck | D2/829 |
| 7,124,921 | B1 * | 10/2006 | Hubbell | 224/148.2 |
| RE39,853 | E * | 9/2007 | Fier | 224/153 |
| 7,266,850 | B1 * | 9/2007 | Strum et al. | 2/2.5 |
| 8,172,117 | B2 * | 5/2012 | Maggi | 224/634 |
| 8,182,439 | B2 * | 5/2012 | Glenn | 602/19 |
| 8,459,518 | B2 * | 6/2013 | Demsky | 224/576 |
| 8,496,149 | B1 * | 7/2013 | Sohm | 224/633 |
| 8,534,523 | B2 * | 9/2013 | Murdoch et al. | 224/581 |
| 8,572,762 | B2 * | 11/2013 | Herbener et al. | 2/2.5 |
| 8,622,263 | B2 * | 1/2014 | Su | 224/153 |
| 8,635,714 | B2 * | 1/2014 | Hazlett | 2/311 |
| 8,814,016 | B2 * | 8/2014 | Murdoch et al. | 224/581 |
| 2005/0082330 | A1 * | 4/2005 | Fehlberg et al. | 224/631 |
| 2007/0012735 | A1 * | 1/2007 | Lee et al. | 224/155 |
| 2008/0010730 | A1 * | 1/2008 | Twito et al. | 2/463 |
| 2009/0127299 | A1 * | 5/2009 | Jamlang | 224/153 |

FOREIGN PATENT DOCUMENTS

| | | | |
|---|---|---|---|
| EP | 2016843 | A1 | 1/2009 |
| EP | 2052632 | A1 | 4/2009 |
| WO | WO2008089128 | A2 | 7/2008 |
| WO | WO2011036107 | A3 | 3/2011 |

* cited by examiner

CARRYING SYSTEM COMPRISING A BALLISTIC BODY ARMOR

RELATED PATENT DATA

The present application claims priority to PCT Application Ser. No. PCT/EP2010/063738, and which was filed Sep. 17, 2010; and German Patent Application Ser. No. 10 2009 042 455.5, and which was filed on Sep. 23, 2009.

The invention relates to a carrying system with a ballistic protective vest with a front part and a back part.

Ballistic protective vests are known from the general prior art. Protective vests or armored or bullet-proof items of clothing to be worn on the body are commonly used by the military and the police to protect people against attacks with stabbing weapons or bullets.

In order to guarantee ballistic protection, the protective vests to be worn on the body usually comprise a bullet-proof composite assembled from multiple layers. A distinction is essentially made between so-called soft ballistic and hard ballistic protection packages. In soft ballistic protection packages, the bullet-proof composite comprises textile materials. The soft ballistic composite contains no additional steel plates, ceramic plates, polyethylene plates or plates of other materials for stopping the incident bullets. This distinguishes the soft ballistic composite from a hard ballistic composite, in which at least one of the above-mentioned plates is used.

If necessary, front and back parts of soft ballistic construction can have stab protection by means of suitable inserts or as a result of a suitable design.

Hard ballistic, bullet-proof composites provide, in contrast to soft ballistic ones, adequate protection against bullets with very high speeds and/or with very hard cores or shell casings, e.g. long-core bullets. For this purpose, rigid composite plates, adapted to the region to be protected, are used in various shapes and sizes.

Known ballistic protective vests generally comprise a front part and a back part, which are intended to provide protection against stab weapons and/or against firearms.

A generic carrying system is known from EP 2 052 632 A1. The carrying system essentially consists of three main components, namely, first, a ballistic protective vest with a front part and a back part and means for attachment to a human upper body. Secondly, the carrying system comprises a waist belt, which can be arranged about the waist of a person, and thirdly, the carrying system comprises two lateral supports, which connect the waist belt to the rear shield-shaped area of the ballistic protective vest, i.e. the back part. Electronic components, such as a radio, can be integrated into the back part of the ballistic protective vest.

The waist belt known from the generic literature with the lateral supports facilitates the wearing of a protective vest without unduly restricting the movement of the wearer. Further, the lateral support can be designed, if necessary, to convert a relative movement, which a human being makes between the hips and upper body during walking, into an electric current. For this see also EP 1 994 841 A1, which protects such a design.

The protective vest known from EP 2 052 632 A1, in combination with the waist belt, has proved to be particularly suitable for military and police missions and applications.

The object of the present invention is to further improve the carrying system known from the prior art with a ballistic protective vest and a waist belt.

According to the present invention, this object is achieved by the teachings Found in claim 1.

According to the present invention, this object is also achieved by the teachings found in claim 35.

By virtue of the fact that the ballistic protective vest comprises a coupling for releasably attaching a carrying means to the rear of the back part of the ballistic protective vest, an advantageous modular construction is achieved which makes it possible for the ballistic protective vest to be added to with further components depending on the application. The modular carrying system thus has a basic element, which is the ballistic protective vest, which can be combined as required with an arbitrarily shaped carrying means. The carrying means that can be coupled to the ballistic protective vest can itself be assembled from several modules, which are separately or jointly coupled to the ballistic protective vest.

The carrying means can be a so-called "electronic backpack", for example. This is understood to mean a housing, which is provided in its interior with electronic components and electronic devices, in particular for military applications.

Further, the carrying means can be a backpack or any device for carrying loads. Preferably, a frame is provided for this, which on the one hand comprises suitable coupling parts, with whose help the frame can be coupled to the back of the ballistic protective vest, and on the other hand comprises appropriate means, with which at least a backpack and/or at least one piece of luggage can be attached to the frame. Furthermore, the frame can be designed such that a load or a substantially horizontally extending luggage support can be attached.

The at least one lateral support provided on the waist belt can be attached to the carrying means (according to claim 1). The carrying means is thus on the one hand coupled to the rear of the back part via the coupling of the ballistic protective vest, and on the other hand to the waist belt via the lateral support. A stable and secure arrangement of the carrying means is achieved in this way. In addition, the weight of the carrying means is conveyed by the lateral support to the region of a person's waist, so that the upper body, in particular the back and shoulders of the wearer, are relieved of the load. According to the prior art it was provided that the lateral support of the waist belt was connected directly to the ballistic protective vest more precisely to the back, shield-shaped part of the ballistic protective vest. The inventor has recognized that, to distribute the forces due to the weight of the carrying means and to achieve as stable a carrying system as possible, it is advantageous to connect the carrying means that is coupled according to the invention directly to the waist belt via the lateral supports.

According to the invention, it can further be envisaged that the carrying means is rotationally connected to the ballistic protective vest via the coupling, so that the carrying means can rotate, at least within an angular range, about a vertical axis essentially perpendicular to the plane of the back part.

The inventor has recognized that a rotational connection of the carrying means to the ballistic protective vest in combination with the lateral supports, which connect the carrying means to the waist belt, is particularly suitable for guaranteeing a high degree of mobility of the wearer. The solution according to the invention thus enables weight-optimized wearing of the carrying system, without unnecessarily restricting the mobility of the wearer.

The coupling can preferably be designed so that a rotary motion is possible but no pivotal motion is permitted (inclination of the plane of the back part to the parallel extending plane of the carrying means).

The lateral support is preferably connected to the carrying means and the waist belt so as to be pivotable about at least two axes. A high degree of mobility is guaranteed in this way.

A pivotable connection of this type can in principle also be achieved with a ball joint. The inventor has, however, recognized that the design with hinges is suitable in this case, since they allow pivoting over a larger angular range. This allows two hinges in each case to be inserted or combined so as to connect the lateral support to the carrying means or to the waist belt, so that rotary motion is possible about a horizontal axis and about a vertical axis. The horizontal axis is preferably perpendicular to the vertical axis and is aligned so that it lies essentially parallel to an imaginary axis running laterally through a person's body.

It is advantageous if two lateral supports are provided, which lead from two opposing side parts of the waist belt to the carrying means and are fixed there. "Side parts" and "lateral" are to be understood here to mean to the left and right of the body of a person when the carrying system is worn by a person in the envisaged manner.

In addition, according to the invention a first remote triggering device can be provided for opening the coupling in order to release the carrying means from the ballistic protective vest. This allows the remote triggering device to be mechanically connected to the coupling and to extend in such a manner that an operating element of the remote triggering device is arranged above the upper side (shoulder) or in front of the front side (chest) of a person's upper body when the carrying system is being worn correctly.

The remote triggering device allows the wearer to release the carrying means simply and rapidly. This can be of particular importance, especially for military applications in hazardous situations, if the wearer has to depart rapidly from their current position.

The coupling and the remote triggering device that works in conjunction with it can preferably be designed so that the remote triggering device opens a fastening device of the coupling, so that the coupled carrying means preferably falls downwards, and hence under the assistance of the weight of the carrying means, out of the coupling.

It is advantageous if the lateral support is formed of preferably two rod-shaped supporting elements. This allows preferably a first supporting element to lead directly from the waist belt to the carrying means and to be attached there to suitable corresponding receiving elements. The second supporting element can be arranged on the carrying means so as to be preferably vertically offset relative to the first rod-shaped supporting element. The end of the second supporting element remote from the carrying means is preferably not directly attached to or mounted on the waist belt, but is attached to the first supporting element via a connecting element. The connecting element is preferably axially movably arranged on the first supporting element, so that its position can be altered depending on the physique of the wearer. It is also advantageous that the lateral support engages the waist belt at only one attachment point. This simplifies the introduction of the forces due to the weight of the carrying means. It is additionally advantageous that the two supporting elements engage receiving elements of the carrying means vertically offset from one another. The carrying means is thus particularly well stabilized. In contrast, if the supporting elements only engaged one receiving element of the carrying means, this has the disadvantage that torques could arise, whereby the receiving element on the carrying means would be correspondingly loaded.

It is advantageous if the lateral support comprises a rod/tube combination, so that the relative movement that a person generates between the hips and the upper body while walking leads to a movement of the rod in the tube, whereby the rod/tube combination is designed so that a movement of the rod in the tube generates an electric current. See the solution known from EP 1 994 841 A1 for this.

However, it is clearly not necessary for the carrying system according to the invention that the lateral support comprises a rod/tube combination that is used to generate electricity. Nevertheless, such a design is advantageous when the carrying means comprises a housing with electronic components, the so-called "electronic backpack". Power generation can, however, also be used for other electrical devices and components that the wearer of the carrying system carries with him.

It is advantageous if the lateral support comprises damping elements, preferably spring elements. This is particularly useful if the lateral support comprises two preferably rod-shaped supporting elements.

It is advantageous if the carrying means comprises at least a first module, which is directly connected to the ballistic protective vest via the coupling. The first module can comprise a coupling for releasably coupling a second module to the back of the first module. The coupling for attachment of the second module to the back of the first module may preferably be a spigot joint.

It is advantageous if the second module is connected to the first module in a torsionally rigid manner. Preferably, the second module comprises a frame that encloses the first module on its outer periphery in an at least partially interlocking manner. This results in a particularly stable and in particular also torsionally rigid connection between the first module and the second module.

According to the invention, it can also be envisaged that the second module comprises hook-shaped connecting elements, which can be suspended in corresponding, preferably pin-shaped connecting elements of the first module.

In one embodiment of the invention, it may further be envisaged that the frame comprises fastening eyelets, hooks, breakthroughs or similar, so that preferably loads can be easily mounted on the frame. The loads can be, for example, at least one backpack and/or at least one piece of luggage.

It is advantageous if an extension bracket is detachably arranged at the top of the frame. This can be effected, for example, by plugging into corresponding openings of the frame.

According to the invention, a second remote triggering device for opening the coupling between the first and the second modules can be provided to release the second module from the first module. The second remote triggering device can, similarly to the first remote triggering device, be mechanically connected to the coupling of the first module and extend in such a manner that an operating element of the second remote triggering device is arranged above the upper side or in front of the front side of a person's body when the carrying system is being worn correctly.

The second remote triggering device thus allows the second module to be rapidly released from the first module if necessary. This makes it easier to use and can be advantageous if the wearer of the carrying system must shed weight quickly.

It is advantageous if the first module is a housing, in which electronic components and/or electronic devices are accommodated. Further, it is advantageous if the second module is a frame on which at least a backpack and/or at least a piece of luggage are mounted.

According to the invention, it can be envisaged that coupling parts of the second module, which are designed for coupling to the coupling of the first module, are also formed for coupling to the coupling of the ballistic protective vest. Alternatively, it can also be envisaged that the second module comprises coupling parts for connection to the coupling of the first module, and comprises coupling parts different from these for connection to the coupling of the ballistic protective vest, wherein the second module preferably comprises a receptacle into which the particular required coupling part can be inserted. The receptacle can preferably be a snap connection or similar for this purpose.

Both alternatives enable flexible and modular use of the carrying system. If necessary, therefore, only the housing with the electronic components or the frame for carrying loads can be coupled to the protective vest. Where both modules are required, the housing with the electronic components can be preferably coupled to the protective vest first and then the frame for supporting the loads can be coupled to the rear of the housing.

It is advantageous if the frame comprises receiving elements, to which the lateral supports provided on the waist belt are attachable. The receiving elements of the frame preferably correspond to the receiving elements that are preferably arranged laterally on the housing for the electronic components. This enables the lateral support to be easily detached from the housing if necessary and attached to the frame if the frame is to be used without the housing.

It is advantageous if the ballistic protective vest is of soft ballistic form at the front part and/or at the back part. Preferably, the ballistic protective vest is of soft ballistic form both at the front part and at the back part. Appropriate designs for this purpose are known from the prior art. The use of so-called composite materials is particularly suitable. The soft ballistic embodiment of the protective vest can preferably be carried out in such a way that the protective vest comprises several layers of a textile material, preferably aramid, e.g. aromatic polyamide fibers. Instead of aramid, other layers are known from the general prior art, which are suitable for the formation of a soft ballistic composite. Alternatively to, or preferably as an extension of, a soft ballistic embodiment, the ballistic protective vest can be provided with hard ballistic inserts at its front part and/or back part. The hard ballistic inserts can be permanently integrated or can be used as required with suitable insertion means and removed again later. The hard ballistic inserts can comprise or can be in the form of a rigid, bullet-proof plate. The plate can be made of ceramic, preferably a high performance ceramic, polymers, polyethylenes, metals or a combination of the aforesaid materials. Boron carbide is particularly suitable for this. The hard ballistic inserts can preferably be joined to one or more layers of a fabric, preferably of aramid. The fabric can preferably be irreversibly and rigidly joined to the hard ballistic plate by means of an adhesive tape or glue under the influence of pressure and temperature.

In one embodiment of the invention, the protective vest can be provided with ventilation ducts, through which the air can be pumped or sucked, preferably using a fan. Such ducts are known from EP 2 016 843 A1.

The carrying system as disclosed in claim 35 comprises a ballistic protective vest with a front part and a back part and means for attaching to a person's upper body. Further, a waist belt is provided, on which at least one lateral support is provided/attached. The carrying system envisaged according to the invention is thereby envisaged to further comprise at least one flat housing at least approximately adapted in height and width to the back part of the protective vest, and in whose interior electronic components and/or electronic devices are received and arranged. Further, the carrying system is envisaged to comprise at least one frame for carrying loads, and whose height and width correspond at least approximately to the housing for accommodating the electronic devices. Further, the housing and the frame are envisaged to comprise receiving elements, to which the lateral support provided on the waist belt can be attached. The protective vest, the housing and the frame are envisaged to be constructed so that the housing and the frame can each be directly coupled to the rear of the protective vest. In addition, the housing and the frame are envisaged to be constructed relative to each other in such a way that the frame can be alternatively also coupled to the rear of the housing.

The present invention thus relates to a particularly advantageous carrying system of modular construction, whose basis is a ballistic protective vest and a waist belt with lateral supports.

An advantageous frame for carrying loads for a carrying system results from the teachings as found in the paragraphs which follow. An advantageous housing having an interior, in which electronic components and/or electronic devices are arranged, for use as a first module for a carrying system is further described herein.

Advantageous embodiments and developments of the invention are evident from the attached claims. An example of the invention in principle is illustrated below.

IN THE DRAWINGS

Figure 1:
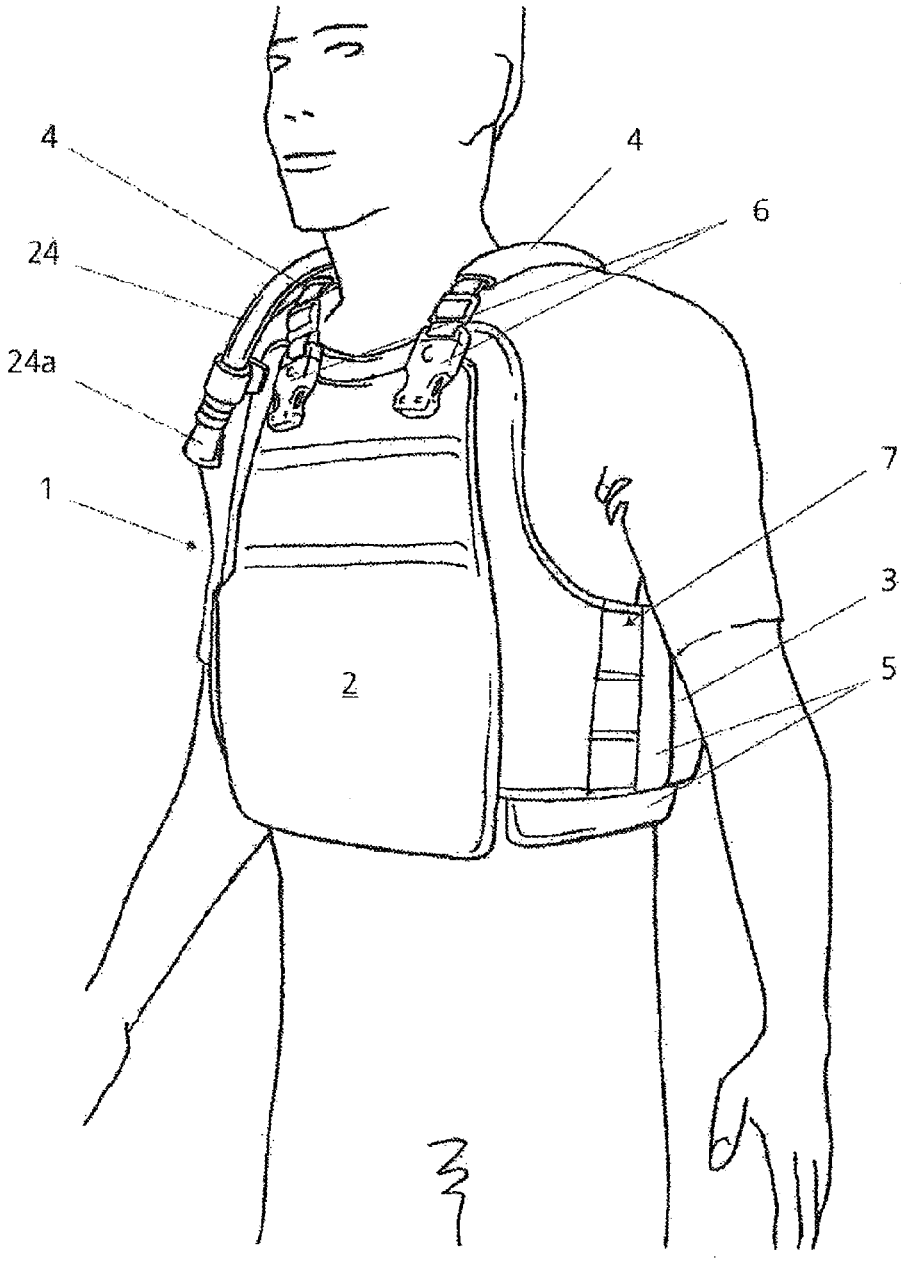
FIG. 1 is a perspective illustration from the front of a ballistic protective vest being worn on a person's upper body.
Figure 3:
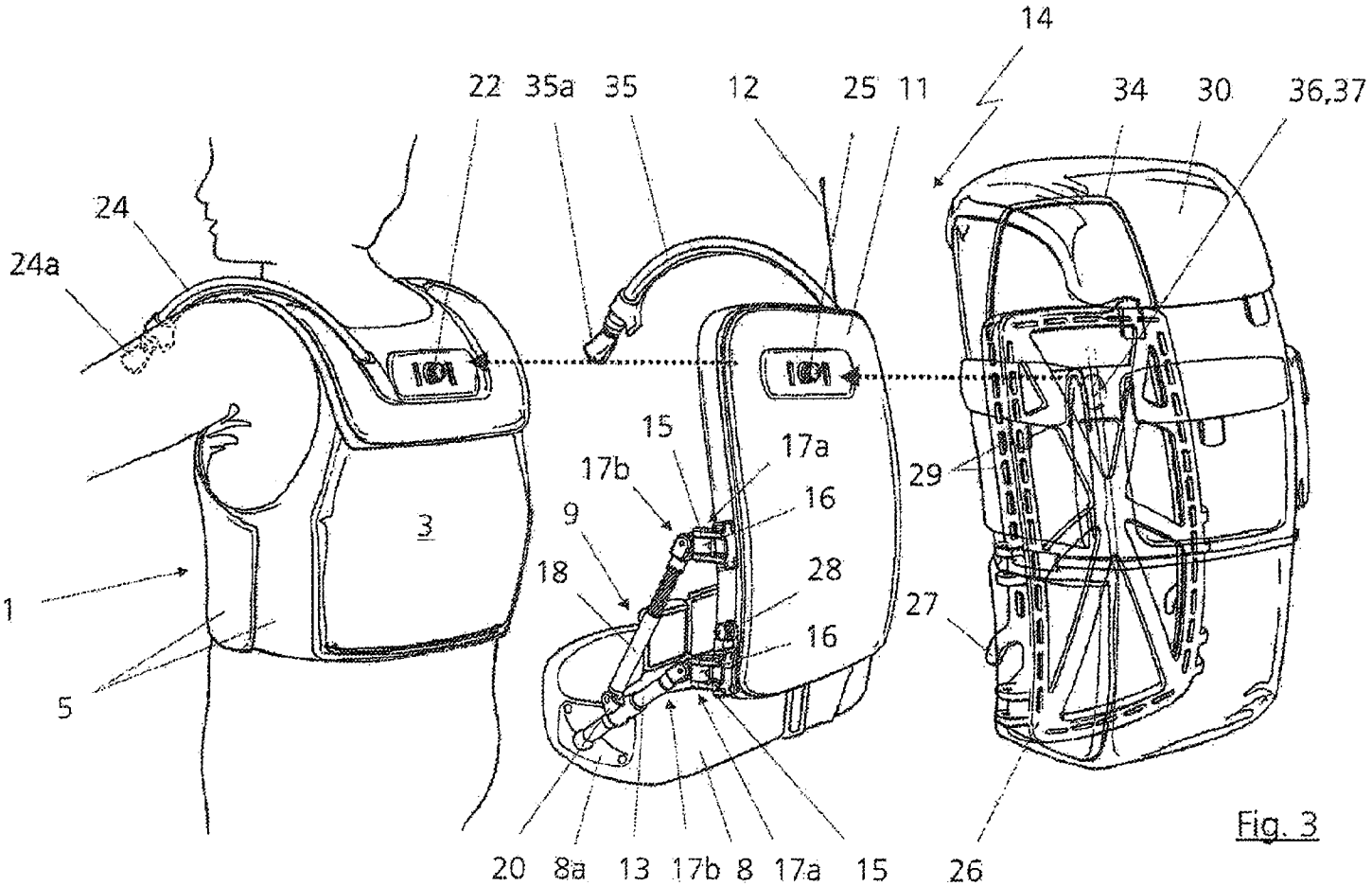
FIG. 3 is a side view for clarification of the principle of the modular construction and showing a protective vest, a waist belt with two lateral supports, a housing for accommodating electronic components and a frame for carrying loads, on which a backpack is arranged.

FIG. 1 shows a ballistic protective vest 1 with a front part 2 and a back part 3 (shown in detail in FIG. 3). A means 4, 5 is provided for attachment to a person's upper body. In the exemplary embodiment, the means for attachment of the ballistic protective vest 1 to a person's upper body are formed by carriers 4 or by textile tapes, which extend on both sides of the neck over the shoulder of the wearer and terminate in click or snap fasteners 6, in order to join the back part 3 to the front part 2. The snap fasteners 6 are arranged in the vicinity of the front part 2, so that they can be easily opened and closed by the wearer of the carrying system.

In addition, expanding elastic connectors are provided, which join the front part 2 to the back part 3 on both side of the person's body. In the exemplary embodiment, the means here are in the form of fabric panels 5 or fabric flaps, each extending from the front part 2 or the back part 3 and connected to each other by a hook and loop fastener 7 in the vicinity of the side of a person.

The ballistic protective vest 1 illustrated in the drawings is of a soft ballistic construction. In this case, both the front part 2 and the back part 3 are of soft ballistic construction. Composite materials are particularly suitable for this. Aramid layers are preferably used. In addition, in the exemplary embodiment the front part 2 and the back part 3 can be further provided with hard ballistic inserts, which are not illustrated in detail and which can be inserted into pockets or inserts of the protective vest 1, and which are suitable to withstand even long-core bullets. Ceramic plates or steel plates are particularly suitable as hard ballistic inserts.

Figure 2:
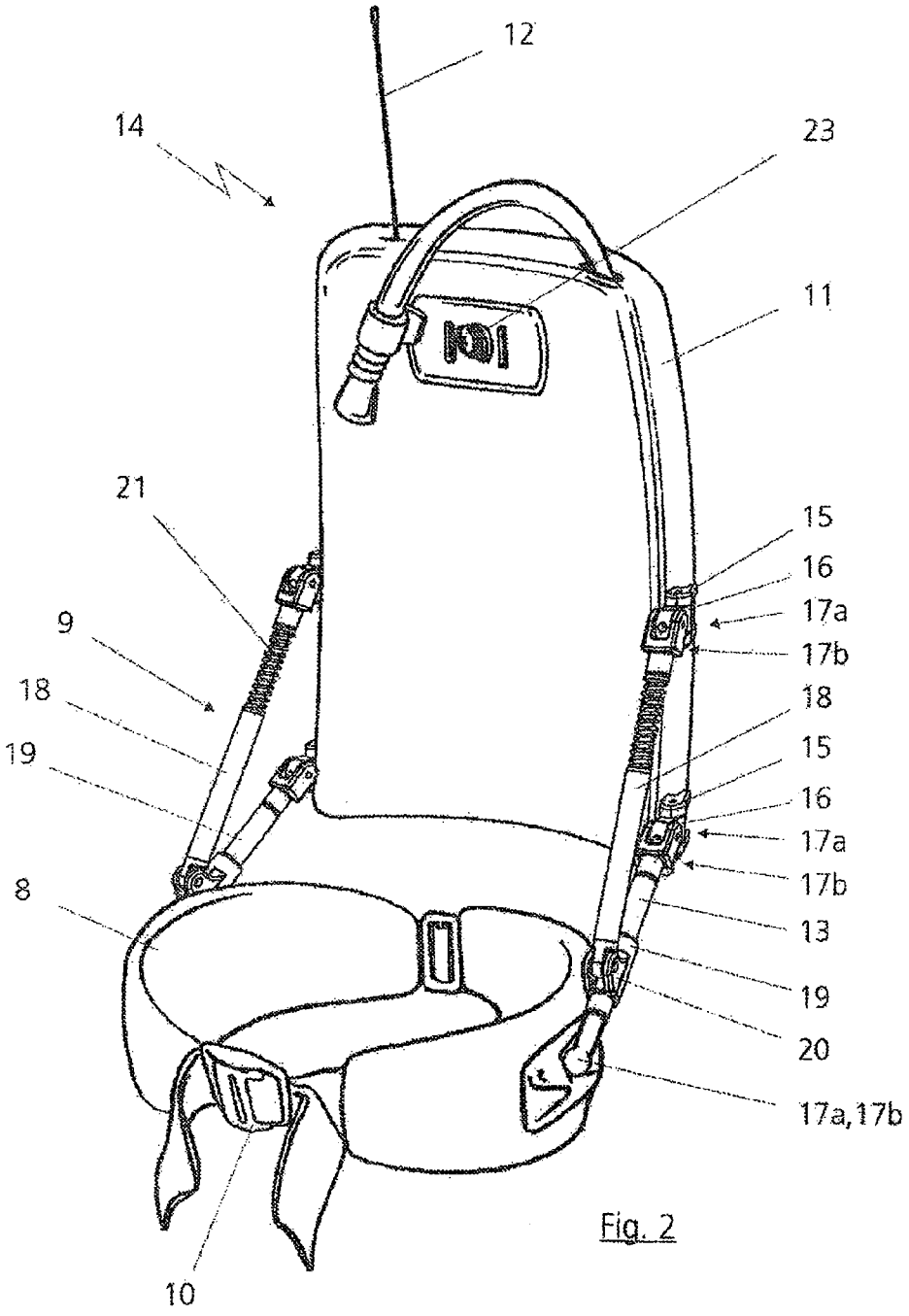
FIG. 2 is a perspective illustration from the front of a waist belt, and which is joined to a housing for accommodating electronic components by two lateral supports.

FIG. 2 shows a waist belt 8, on which two lateral supports 9 are provided or attached. The illustrated waist belt 8 comprises two adjustment options, with which the length of the waist belt 8 can be varied and thus adapted to the waist measurement of the wearer. One adjustment option is implemented at the rear of the waist belt 8, the other by a fastener 10 at the front. Lateral supports 9 are arranged on both side parts of the waist belt 8. "Side parts" and "lateral" are to be understood to mean that the lateral supports 9 are located on the left and right of the body of a person when the carrying system is being worn correctly.

In the exemplary embodiment illustrated in FIG. 2, the lateral supports 9 are attached at one end to the waist belt 8 and at the other end to a carrying means 14. The carrying means 14 comprises a first module 11, to which the end of the lateral support 9 remote from the waist belt 8 is attached. In the exemplary embodiment, the first module 11 forms a part of the carrying means 14. In one embodiment, the first module 11 can even be the only part of the carrying means 14. In FIG. 2, the first module 11 is a housing, in whose interior electronic components and/or electronic devices are accommodated in a manner which is not illustrated. Of the accommodated electronic devices, in FIG. 2 only an antenna 12 of a radio device can be seen, which protrudes out of the upper side of the housing 11.

The housing 11 is of flat construction and its height and its width are at least approximately adapted to the height and width of the back part 3 of the ballistic protective vest 1.

As is further illustrated in FIG. 2, each lateral support 9 comprises a first rod-shaped supporting element 13, which leads from the waist belt 8 to the housing 11.

The housing 11 (or generally the carrying means 14) comprises receiving elements 15, at which one end of the first supporting element 13 can be joined to the housing 11. The receiving elements 15 are constructed in such a way that they form a hinge 17*a* together with a connecting element 16 of the first supporting element 13. The hinge 17*a* enables a rotary motion of the first supporting element 13 about a vertically extending axis when the carrying means is being worn correctly. This is particularly evident from FIG. 6.

In addition, the first supporting element 13 comprises a second hinge 17*b*, which is formed by the supporting element 13 and which allows a rotary motion about a horizontal axis. This horizontal axis is perpendicular to the vertical axis of the first hinge 17*a*. The horizontal axis extends essentially parallel to an imaginary axis, which would extend laterally through a person's body. This horizontal axis is preferably formed in such a way that it lies approximately on a straight line which would connect two receiving elements 15 (for the first supporting element 13) formed on two opposite sides of the housing 11.

Figure 6:
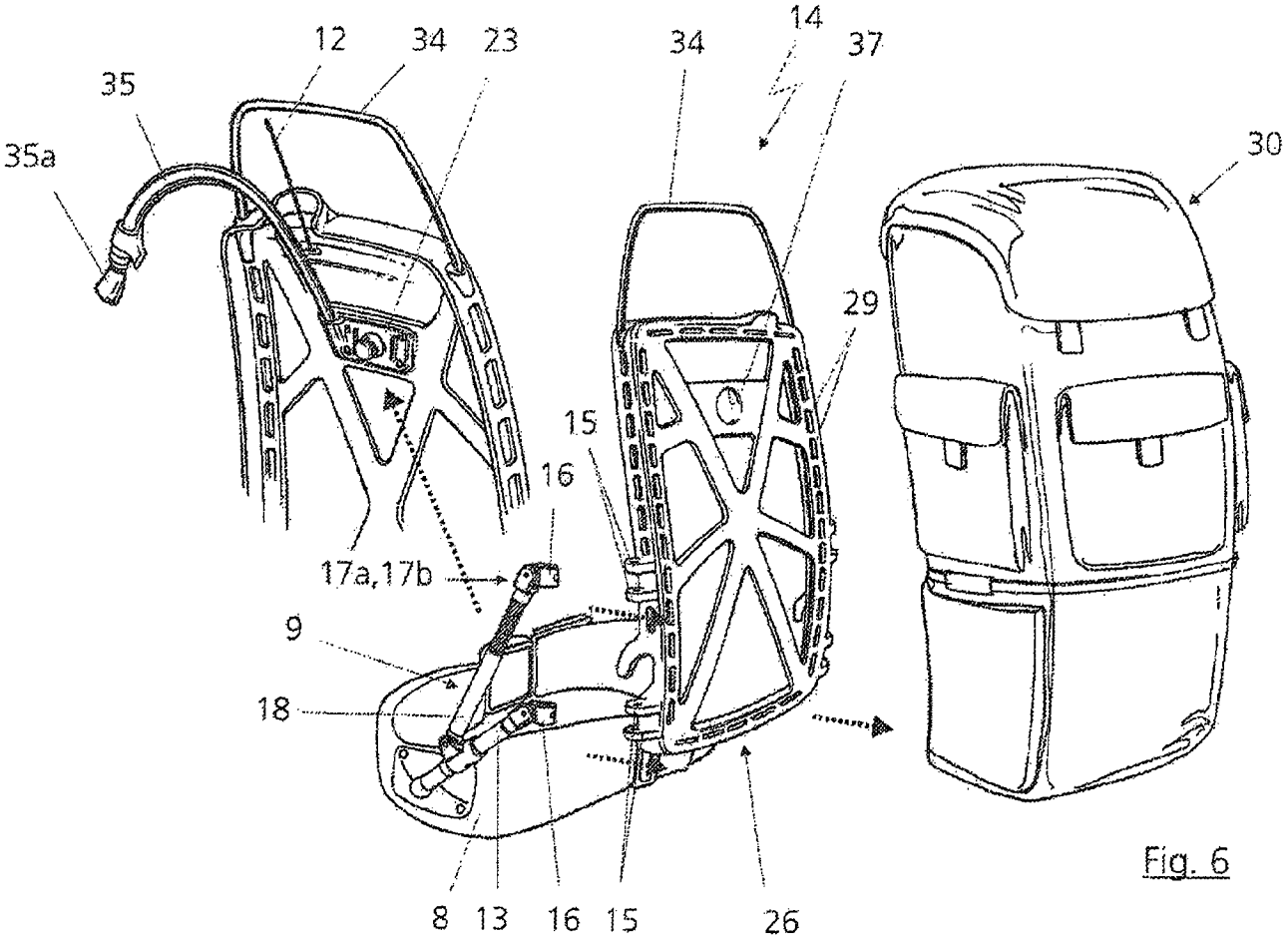
FIG. 6 is a side view for clarification of the option of arranging the waist belt with the lateral supports on the frame for carrying loads.

As is particularly evident from a comparison of FIG. 2 and FIG. 6, the connecting element 16 is part of hinge 17*a* and part of hinge 17*b*.

In a manner that is not illustrated, the connection of the first supporting element 13 to the waist belt 8 is preferably carried out in a similar way via two hinges 17*a*, 17*b*. These can be designed in the same way as the hinges 17*a*, 17*b* for the connection to the housing 11. In the exemplary embodiment, only a single ball joint is shown on the waist belt 8 at this point for reasons of simplicity of illustration.

As a result of the design of hinges 17*a*, 17*b*, the waist belt 8—compared to a ball joint—can be rapidly and simply attached to and removed from the receiving elements 15.

As shown further in FIG. 2, the lateral support 9 comprises a second rod-shaped supporting element 18, which leads to the carrying means 14 or, in accordance with FIG. 2, to the housing 11. The second supporting element 18 engages the housing 11 at a vertically displaced point above the first rod-shaped supporting element 13. The second supporting element 18 is in the exemplary embodiment likewise arranged on the housing 11 so as to pivot on two hinges 17*a*, 17*b*. The construction in this case can correspond to the already described construction. The axes of the second supporting element 18 are preferably each parallel to the axes that arise from the pivotable attachment of the first supporting element 13.

The end of the second supporting element 18 remote from the housing 11 is connected via a connecting element 19 to the first supporting element 13. The connecting element 19 is attached to the first supporting element 13 so as to be axially displaceable. The connecting element 19 externally encloses the first supporting element 13 in the exemplary embodiment. The carrying system according to the invention can be adjusted to persons of various sizes by means of the connecting element 19 and/or its axial displacement capability on the first supporting element 13. The connection of the end of the second supporting element 18 to the connecting element 19 takes place via a hinge 20 in such a manner that the axis of rotation extends essentially parallel to the already described horizontal axis of rotation of the hinge 17*b*.

For the purpose of damping, the second supporting element 2 comprises a damper 21, which in the exemplary embodiment illustrated in FIG. 2 is in the form of a spring, in particular a spiral spring.

In the exemplary embodiment it can be envisaged that one of the supporting elements 13, 18 is formed as a rod/tube combination, so that the relative movement between the hips and the upper body generated by a person when walking leads to a movement of the rod in the tube. The rod/tube combination can be designed in this case so that a movement of the rod in the tube generates an electric current. This can optionally be used to charge a battery or to supply the electronic components accommodated in the housing 11, in particular a radio device. This is an optional embodiment. In the exemplary embodiment it can be envisaged that the second supporting element 18, preferably both second supporting elements 18, are constructed as rod/tube combinations for generating power. For details refer to EP 1 994 841 A1, in particular its FIG. 8.

A design of the second supporting element 18 as a rod/tube combination is also suitable without designing the rod/tube combination for power generation. With the use of a damper 21, as is illustrated in principle for example in FIG. 2, the rod/tube combination allows the design of a particularly suitable damping system. In this system the damper 21, which is a spring for example, encloses a section of a rod, which is led or extends in a tube section above, or as illustrated in FIG. 2 beneath, the spring 21. This enables a stable embodiment of the supporting element 18 to be implemented on the one hand, and good damping to be achieved on the other hand. Preferably it can be envisaged that the second supporting element 18 can be telescopic, so that the carrying system can be easily adjusted to individual sizes.

In principle it is also possible that both supporting elements 13, 18 are designed as rod/tube combinations using a suitable damper, preferably a spiral spring.

In a manner that is not illustrated, it is also possible in principle for the lateral support 9 to comprise more than two supporting elements.

For connecting the lateral support 9 to the waist belt 8, in the exemplary embodiment of the first supporting element 13 it can be envisaged that the waist belt 8 is strengthened in the contact region. In the exemplary embodiment, a reinforcing plate 8*a* is provided for this purpose. On grounds of clarity, the reinforcing plate 8*a* is shown relatively large. It is to be preferred, however, that the reinforcing plate 8*a* has the smallest possible dimensions, so that the flexibility of the waist belt 8 is affected as little as possible.

As is apparent from a comparison of FIG. 1, FIG. 2 and FIG. 3, the ballistic protective vest 1 has a coupling 22 for releasably attaching a carrying means 14 to the rear side of the back part 3 of the ballistic protective vest 1. In the embodiment illustrated in FIGS. 1, 2 and 3, the carrying means 14 comprises a first module 11, as has already been described. This first module, which in the exemplary embodiment is in the form of a housing 11, is connected via the coupling illustrated in FIG. 3 to the ballistic protective vest 1. The housing 11 comprises a coupling part 23, which can be coupled to the coupling 22, whereby the housing 11 is attached to the ballistic protective vest 1. The coupling 22 and the coupling part 23 that corresponds to it can be configured as desired. The coupling 22 is preferably in the form of a central coupling, whereby only one coupling part 23 has to be inserted into a coupling for closing.

Figure 10:
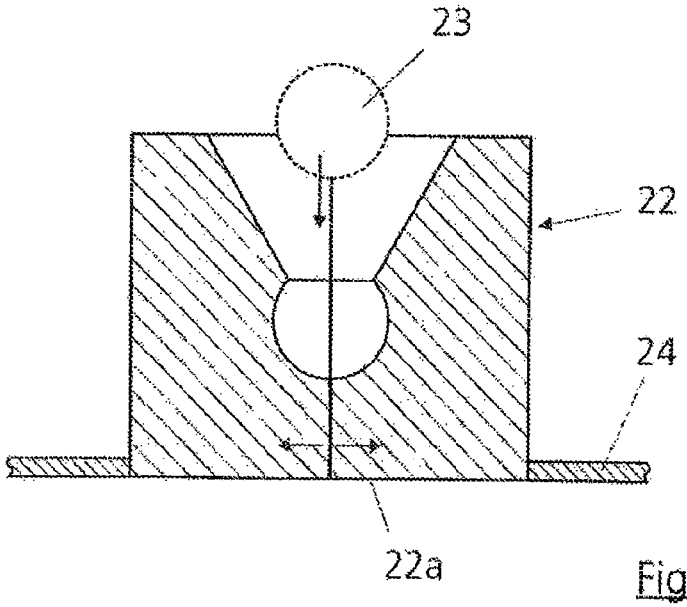
FIG. 10 is an illustration of the principle of a coupling of the ballistic protective vest, into which a coupling part of the housing is coupled.

An embodiment of the coupling as illustrated in FIG. 10 is particularly suitable. It is particularly suitable if the coupling 22 comprises an insertion region or a lock region that narrows preferably in a V-shape towards the locking position. In this way the coupling part 23 can be particularly simply inserted into the coupling 22. This is particularly advantageous if the wearer wishes to attach the housing 11 or generally the carrying means 14 independently after the ballistic protective vest 1 has already been attached.

FIG. 10 shows in principle a possible design of a coupling 22. With this an essentially V-shaped lock region (or a self-locating opening) is envisaged, into which a coupling part 23 of the first module 11 can be inserted from above. The coupling part 23 is illustrated with dashed lines in the lock region. The coupling part 23 can be moved downwards in the lock region until it has reached a locking position of the coupling 22. This movement is assisted by the weight of the module 11. Preferably, the coupling part 23 drops automatically into the locking position and is secured there against unintentional removal.

The coupling part 23 preferably latches in the locking position.

The coupling 22 is implemented in the exemplary embodiment in such a manner that the carrying means 14 or the housing 11 is rotatably connected to the ballistic protective vest 1 via the coupling 22. A rotation can thus occur in such a way that the carrying means 14 or the housing 11 is rotatable at least within an angular range about an axis that is essentially perpendicular to the plane of the back part 3. This enables lateral movements, in particular flexing movements of the trunk, of the wearer to be particularly well compensated. This can be achieved, for example, by an embodiment of the coupling 22 as a spigot joint.

As can be seen further from a comparison of FIG. 1 and FIG. 3, a first remote triggering device 24 is provided for opening the coupling 22, in order to release the carrying means 14 or the housing 11 from the ballistic protective vest 1. The remote triggering device 24 can be designed as desired. In the exemplary embodiment it is envisaged that the first remote triggering device 24 is mechanically connected to the coupling 22 and extends in such a way that an operating element 24*a* of the first remote triggering device 24 is arranged on the upper side or the front side of a person's upper body if the carrying system is being worn correctly.

As is clear from the illustration of the principle in FIG. 10, it may be envisaged in a particularly simple embodiment that the first remote triggering device 24 removes or pulls clear or opens a part 22*a* of the coupling 22 arranged below the coupling part 23 and formed as a fastener, in such a way that the coupling element 23 falls out of the coupling 22 and thus breaks the connection between the carrying means 14 or the housing 11 and the back part 3 of the ballistic protective vest 1. The coupling 22 is preferably opened by pulling.

A particular advantage of the carrying system according to the invention is that the connection between the carrying means 14 or the housing 11 and the body of the wearer of the carrying system is made at only three points, namely via the coupling 22 and the two lateral supports 9. The coupling 22 enables a rotary movement of the type already described in an advantageous manner. Further, the lateral supports 9, in particular the second supporting elements 18, allow a high degree of mobility by means of their damping systems. A rotatable arrangement of the housing 11 via the coupling 22 alone would not achieve the desired effect, if the damping system did not enable mobility in the hip region.

Figure 4:
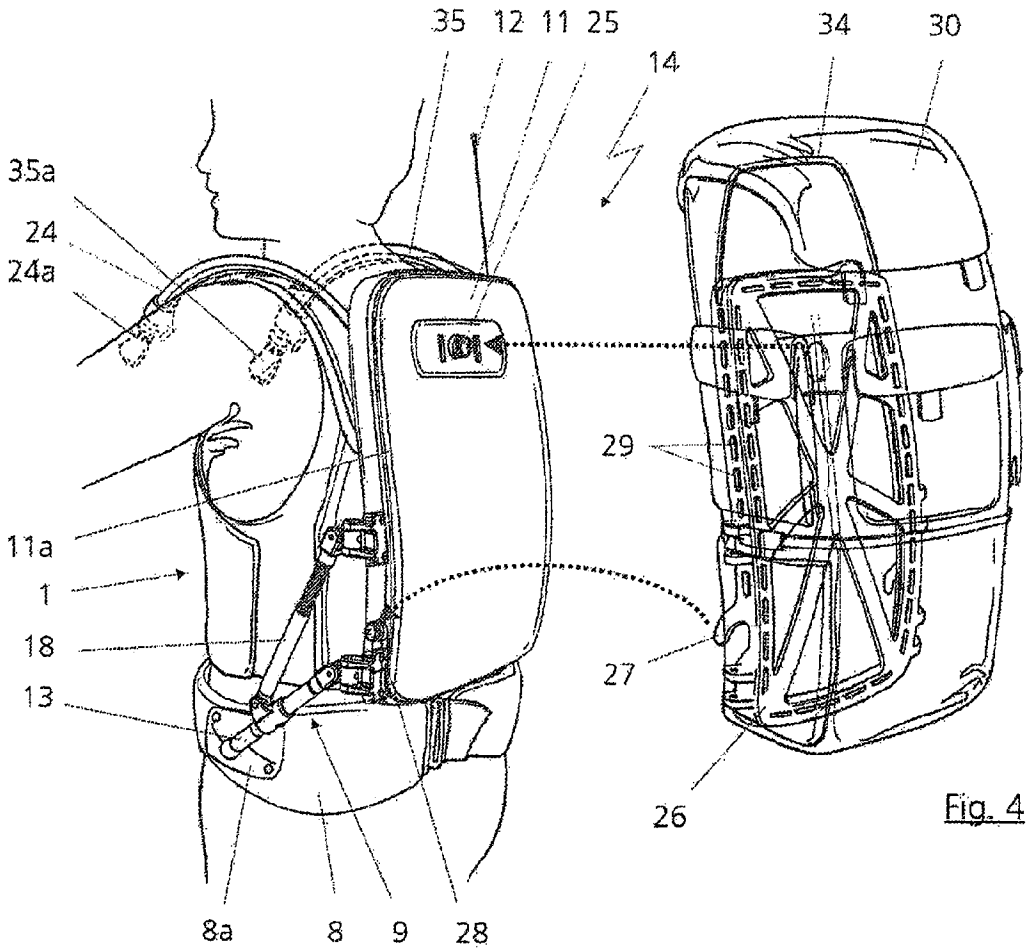
FIG. 4 is an illustration according to FIG. 3, and wherein the waist belt is arranged close to a waist of a person's upper body and the housing is coupled to the protective vest and the waist belt.

Following coupling of the housing 11 to the ballistic protective vest 1, the image illustrated in FIG. 4 results. As is evident from a comparison of FIGS. 3, 4 and 5, the housing 11, which is the first module, comprises a coupling 25 for removably coupling a second module 26 to the rear of the housing 11. The coupling 25 is therefore formed on the rear of the housing 11. The coupling 25 in the exemplary embodiment is a spigot joint.

In the exemplary embodiment it is envisaged that the second module 26 is torsionally rigidly connected to the first module 26. In addition, the second module in the exemplary embodiment is a frame 26, which is suitable for carrying loads. The frame 26 for carrying loads has a height and a width which correspond essentially to the height and width of the housing 11. In the exemplary embodiment it is further envisaged that the frame 26 at least partially encloses the housing 11 on its outer periphery in an interlocking manner.

For this purpose the housing 11 can comprise a recess 11*a* in the transition region between its rear side and its side walls (see FIG. 4).

Figure 5:
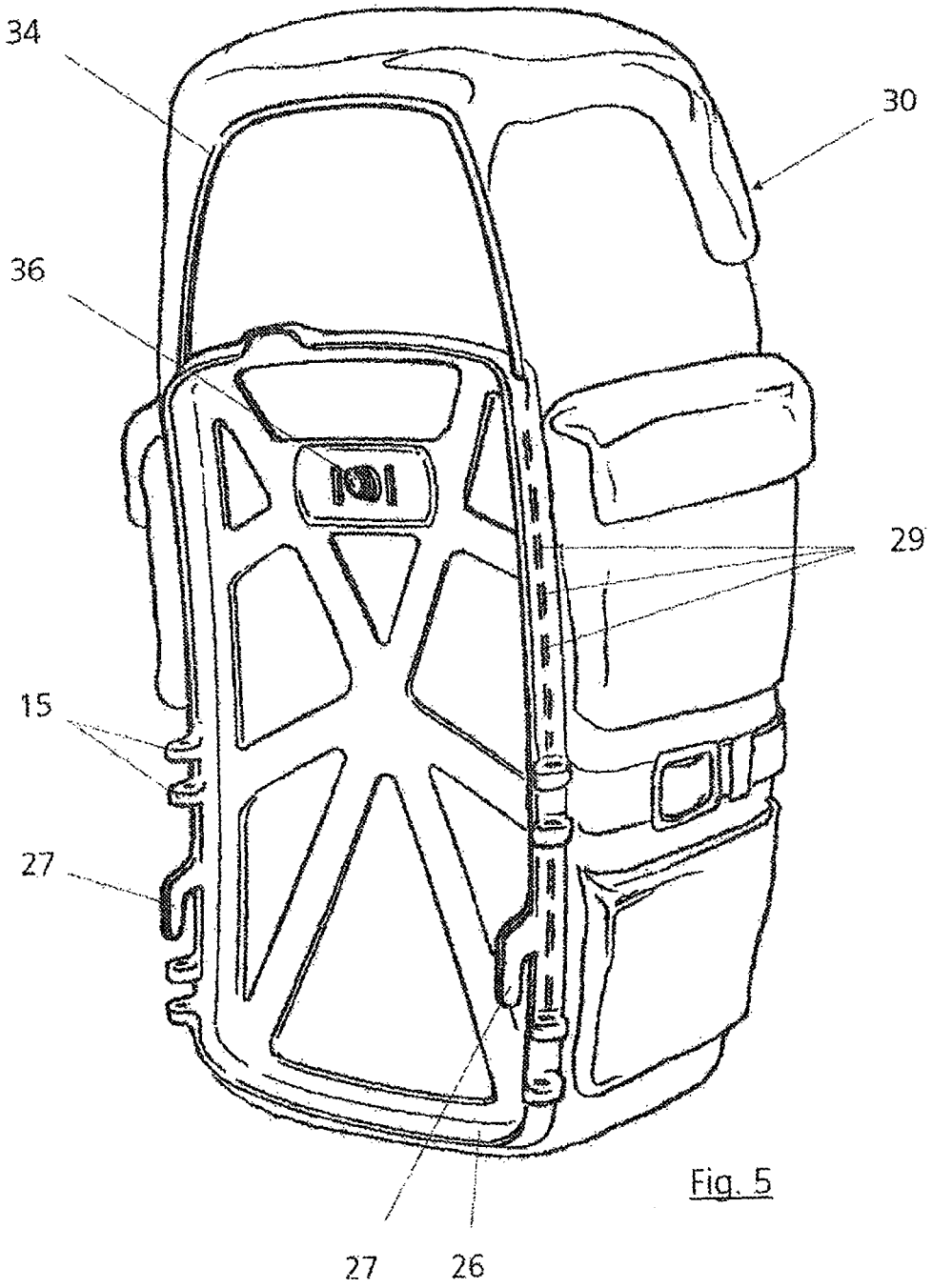
FIG. 5 is a perspective view from the front of the frame for carrying loads, to which a backpack is attached.

As is further evident from FIGS. 3, 4 and 5, the frame 26 comprises hook-shaped connecting elements 27, which can be suspended in pin-shaped connecting elements 28 of the housing 11. The hook-shaped connecting elements 27 and the pin-shaped connecting elements 28 are each formed in a lower region of the frame 26 or the housing 11. In the exemplary embodiment it is envisaged that a connecting element 27, 28 is formed in each case on both long sides of the housing 11 or correspondingly on the long sides of the frame 26. This results in a particularly good, in particular also torsionally rigid connection between the modules 11, 26.

The frame 26 is preferably made of plastic, e.g. of polyamide, and can be provided with suitable reinforcing inserts.

Figure 7:
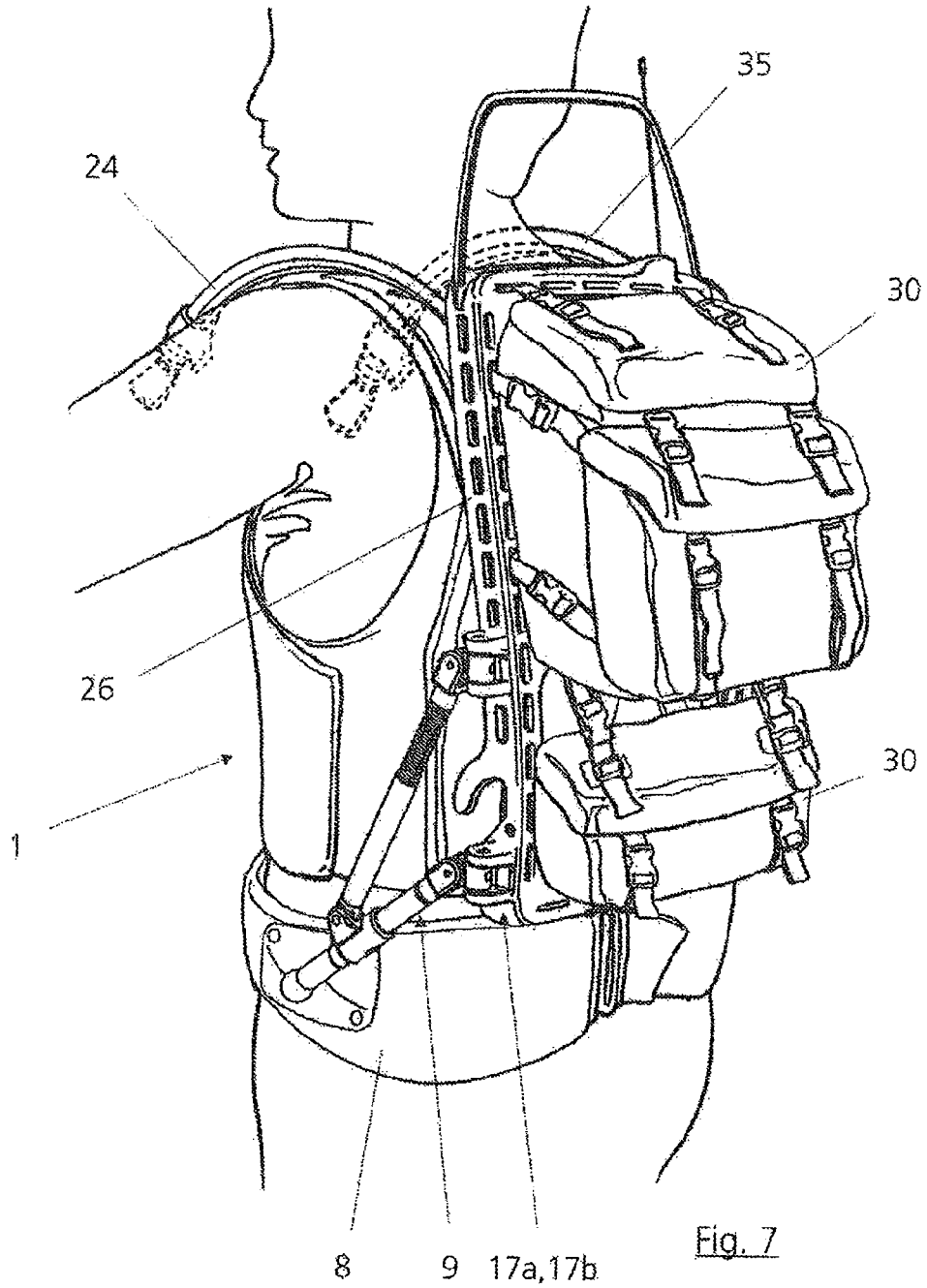
FIG. 7 is a perspective illustration from the rear of the carrying system, and wherein a frame for carrying loads is directly coupled to the rear of a ballistic protective vest without interposing a housing, and wherein two backpacks are attached to the frame for carrying loads.
Figure 8:
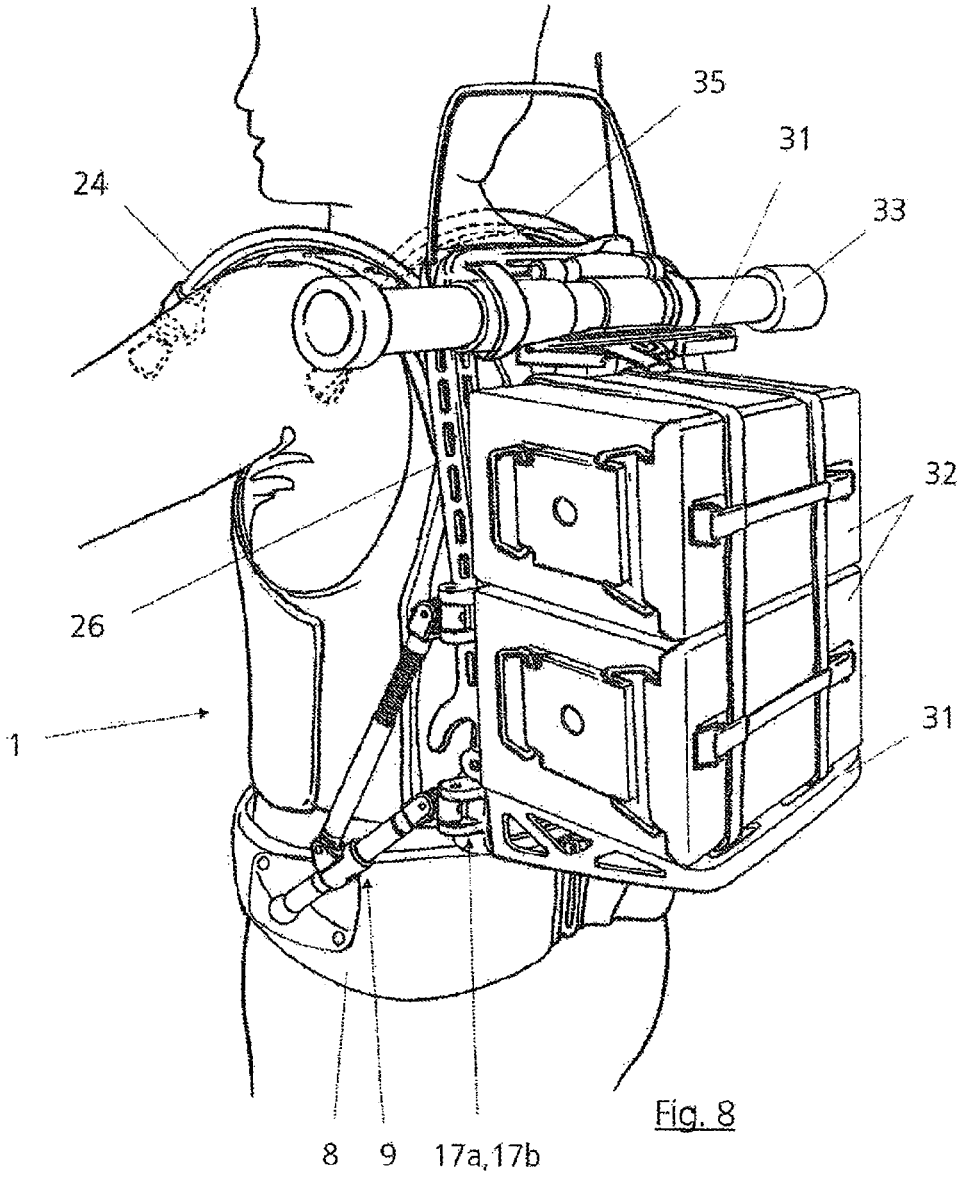
FIG. 8 is an illustration according to FIG. 7, and wherein an essentially horizontal luggage support, on which two pieces of luggage are placed and secured, is attached to the frame.
Figure 9:
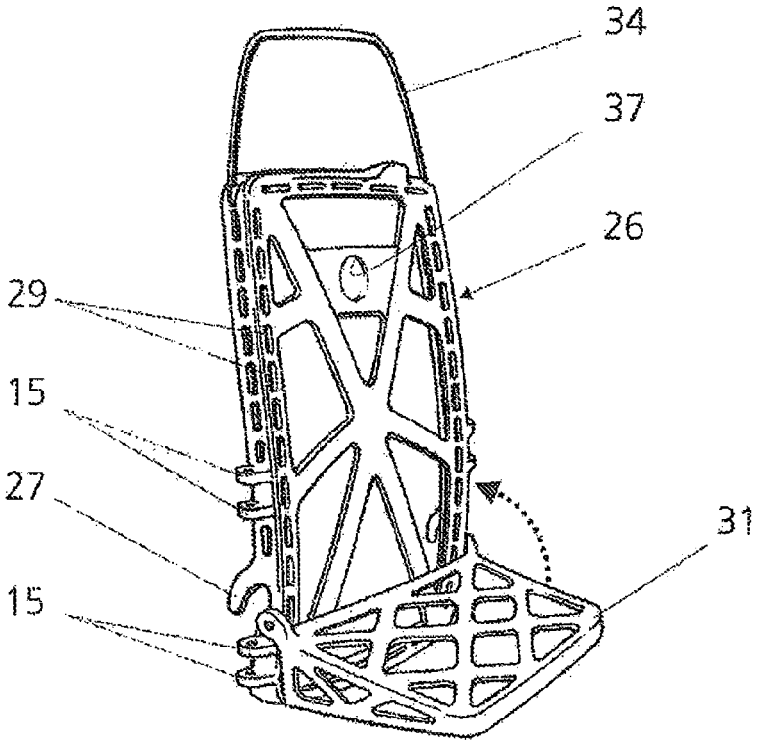
FIG. 9 is a perspective view of the frame with a pivotable luggage support.

The frame 26 comprises fastening eyelets 29 or similar. The fastening eyelets 29 allow loads to be attached to the frame 26 in a simple manner. FIGS. 3, 4 and 5 show that a backpack 30 is mounted on the frame 26. Alternatively, other pieces of luggage can be mounted on the frame 26, as is illustrated in FIGS. 7 and 8. In addition, a luggage carrier 31 can be mounted on the frame 26, as illustrated in FIG. 9. The luggage carrier extends preferably essentially horizontally. The luggage carrier 31 is particularly suitable for accommodating pieces of luggage 32, as illustrated in FIG. 8.

Further bulky items of luggage, e.g. tubular elements 33, such as e.g. an anti-tank system, can be stowed using the fastening eyelets 29. For this purpose, it can also be envisaged that an additional luggage carrier 31 is used.

The frame 26 can be provided with a preferably removable extension bracket 34 on its upper side. This is especially advantageous where a backpack 30 to be transported projects beyond the frame 26 at the top. The backpack 30 can preferably comprise a cuff, with which it can be attached to the extension bracket 34. The extension bracket 34 is preferably made of fiberglass.

As can be further seen from a comparison of FIGS. 3, 4 and 5, a second remote triggering device 35 with an operating element 35*a* is provided for opening the coupling 25 between the first module 11 and the second module 26 in order to release the second module 26, which is the frame in the exemplary embodiment, from the first module 11, which is the housing in the exemplary embodiment. The second remote triggering device 35 can be designed here as already described with respect to the first remote triggering device 24.

In FIG. 4, two remote triggering devices 24, 35 are therefore illustrated, each of which extends on one side of the wearer's neck over the shoulder to the front of the upper body of the wearer.

It is also envisaged with the second remote triggering device 35, that a coupling part 36 of the frame 26 that cooperates with the coupling 25 of the housing 11 is released by influencing the coupling 25, preferably in such a manner that the coupling part 36 drops downwards out of the coupling 25. The hook-shaped connecting elements 27 of the frame 26 automatically release from the pin-shaped connecting elements 28 of the housing 11 when the frame 26 carries out a pivoting motion towards the rear about the pin-shaped connecting elements 28 as a result of the released coupling connection. In an emergency situation, the frame 26 can thus be rapidly ejected with the attached loads.

In the exemplary embodiment it is envisaged that the coupling 25 has a different construction than the coupling 22. This alone can be useful, since the coupling 22 is intended to allow a rotation of the coupled parts, whereas this is preferably not the case with the coupling 25.

In an alternative embodiment it can be envisaged that the coupling part 36 is designed so as to be suitable for coupling to the coupling 22.

As is evident from FIG. 5, the frame 26 can preferably comprise a skeletal construction. I.e., a closed rear surface is preferably not envisaged, but only a combination of struts and/or ribs.

As is evident from a comparison of FIGS. 3, 6, 7 and 8, the frame 26 can also be directly coupled to the ballistic protective vest 1, i.e., without a housing 11 being interposed between them.

The frame 26 can thus constitute the first module. All embodiment variants mentioned above relative to the first module 11 can thus be implemented using the frame 26.

In the exemplary embodiment it is envisaged that if the frame 26 is intended to be directly coupled to the ballistic protective vest 1, the waist belt 8 will first be connected to the frame using the lateral supports 9. For this purpose the frame 26 can comprise receiving elements 15, which correspond to those which have already been described in relation to the housing 11. The parts 15, 16, 17*a* and 17*b* described above can thus be implemented in identical form.

It is further envisaged in the exemplary embodiment that the coupling part 36 of the frame 26, which was provided for connecting to the housing 11, is removed. A coupling part 23, which corresponds to the coupling part 23 of the housing 11, is then fitted for connecting the frame 26 to the back part 3 of the ballistic protective vest 1 or to the coupling 22 (see FIG. 6). The frame 26 can comprise a receptacle 37 for simple interchanging of the coupling part 36, 23, in which the respectively required coupling part 23, 36 is inserted. The receptacle 37 can preferably comprise a snap-locking or another interlocking connection that can be changed rapidly.

After connecting the waist belt 8 via the lateral supports 9 to the frame 26, and possibly changing the coupling parts 36, 23, the frame 26 can be directly mounted on the back part 3 of the ballistic protective vest 1, as illustrated in FIGS. 7 and 8. The loading of the frame 26 with loads is illustrated in FIGS. 7 and 8 by way of example. In FIG. 7 the frame 26 is carrying two backpacks 30, whereas the frame 26 according to FIG. 8 is carrying pieces of luggage 32 and 33 with the aid of two luggage holders 31.

The frame 26 comprises an opening on its upper side, which enables an antenna 12 to be passed through it. The antenna 12 is generally associated with the housing 11. In FIG. 6 the antenna 12 is shown only for clarity.

Figure 11:
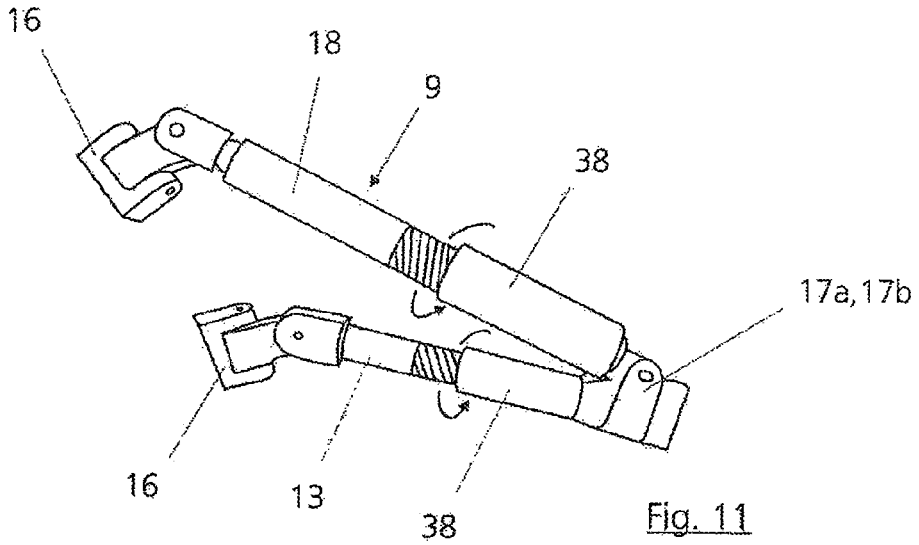
FIG. 11 is an illustration of an alternative embodiment of the lateral support with a length adjustment.

FIG. 11 shows the principle of an alternative embodiment of the lateral support 9. The support 9 illustrated in FIG. 11 comprises a length adjustment means 38 both for the first supporting element 13 and also for the second supporting element 18. The length adjustment means 38 is in the form of a knurled screw in the exemplary embodiment, preferably with a steep pitch, so that a rotation is allowed between a first and a second part of the supporting elements 13, 18 in such a manner that a first part can be screwed into or out of the second part. This allows the distance between the back of the wearer and the carrying system to be adjusted in a particularly simple manner. The length adjustment means 38 can also be designed in an alternative manner, e.g. with a telescopic action of the supporting elements 13, 18. In principle, it can also be envisaged that only one of the two supporting elements 13, 18 comprises a length adjustment means. The length adjustment means can in principle be implemented for all lateral supports 9 and is not restricted to the specific design illustrated in FIG. 11.

Figure 12:
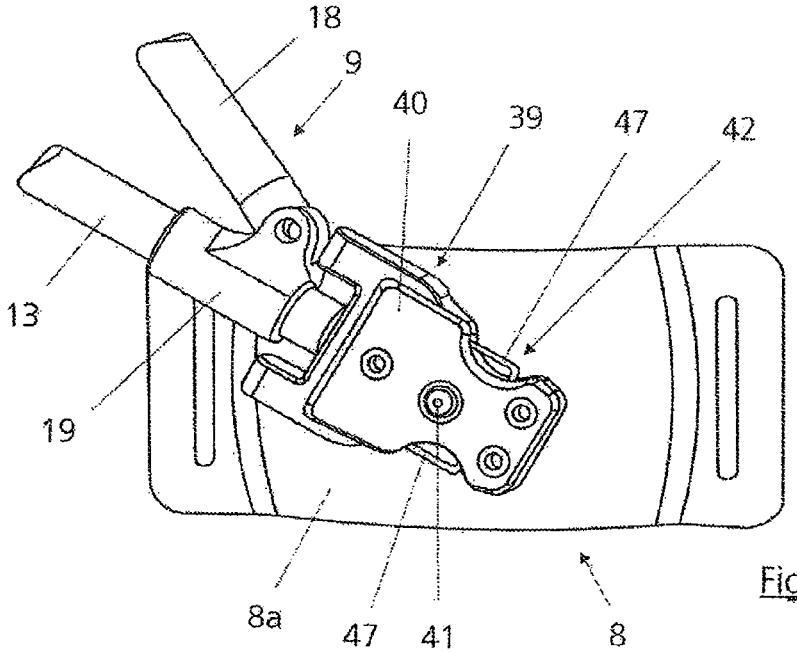
FIG. 12 is an illustration of an alternative for coupling the lateral support to the waist belt via a rapid fastener.

A movable hinge 20, as described in relation to FIGS. 2 to 4, was omitted in the lateral support 9 illustrated in FIG. 11. It is envisaged that the supporting elements 13, 18 are coupled to the waist belt 8 (not shown in FIG. 11) by a hinge combination 17*a*, 17*b*. The coupling to the waist belt 8 can, however, also be carried out with a ball joint, as illustrated in FIGS. 2 to 4, or via a rapid release fastener 39 as illustrated in FIG. 12. Further, in FIG. 11 an axially movable hinge 20 can also be envisaged, via which the second supporting element 18 is connected to the first supporting element 13.

FIG. 12 shows an embodiment in which the lateral support 9 is connected via a rapid release fastener 39 to the waist belt 8 or a connecting plate 8*a* of the waist belt 8. A potential advantageous embodiment of the rapid release fastener 39 is illustrated in principle in FIG. 13.

The waist belt 8 or the connecting plate 8*a* comprises a journal 41 or a pin for coupling the rapid release fastener 39, whereby the journal or pin forms a rotation axis for the rapid release fastener 39 when the rapid release fastener 39 is coupled.

The rapid release fastener 39 comprises a housing 40. The housing 40 comprises an opening 46 shown in detail in FIG. 13 for passing the journal 41 through. The rotational movement of the rapid release fastener 39 about the journal 41 arises from the interaction between the journal 41 and the opening 46 in the housing 40 of the rapid release fastener 39. The connection of the lateral support 9 to the rapid release fastener 39 is illustrated in the exemplary embodiment in FIG. 12 by way of example. The design of the lateral support 9 in FIG. 12 is also exemplary. It is suitable in principle for all embodiments of the lateral support 9 described above and for a connection to the waist belt 8 using a rapid release fastener 39.

As is further evident from FIG. 12, the rapid release fastener 39 comprises a fastener part 42 for locking and releasing the journal 41. Only two parts 47 of the fastener part 42 can be detected in FIG. 12, which are shown in detail in FIG. 13 and whose operation enables the release of the rapid release fastener 39. In the exemplary embodiment, the fastener part 42 of the rapid release fastener 39 is a spring element or a preferably one-piece bent wire. Such a wire-spring element is disclosed in EP 07108898. The bent wire is constructed in such a manner that compressing the two parts 47 together releases the journal 41.

In the exemplary embodiment it is envisaged that both lateral supports 9 are coupled to the waist belt 8 via rapid release fasteners 39.

Figure 13:
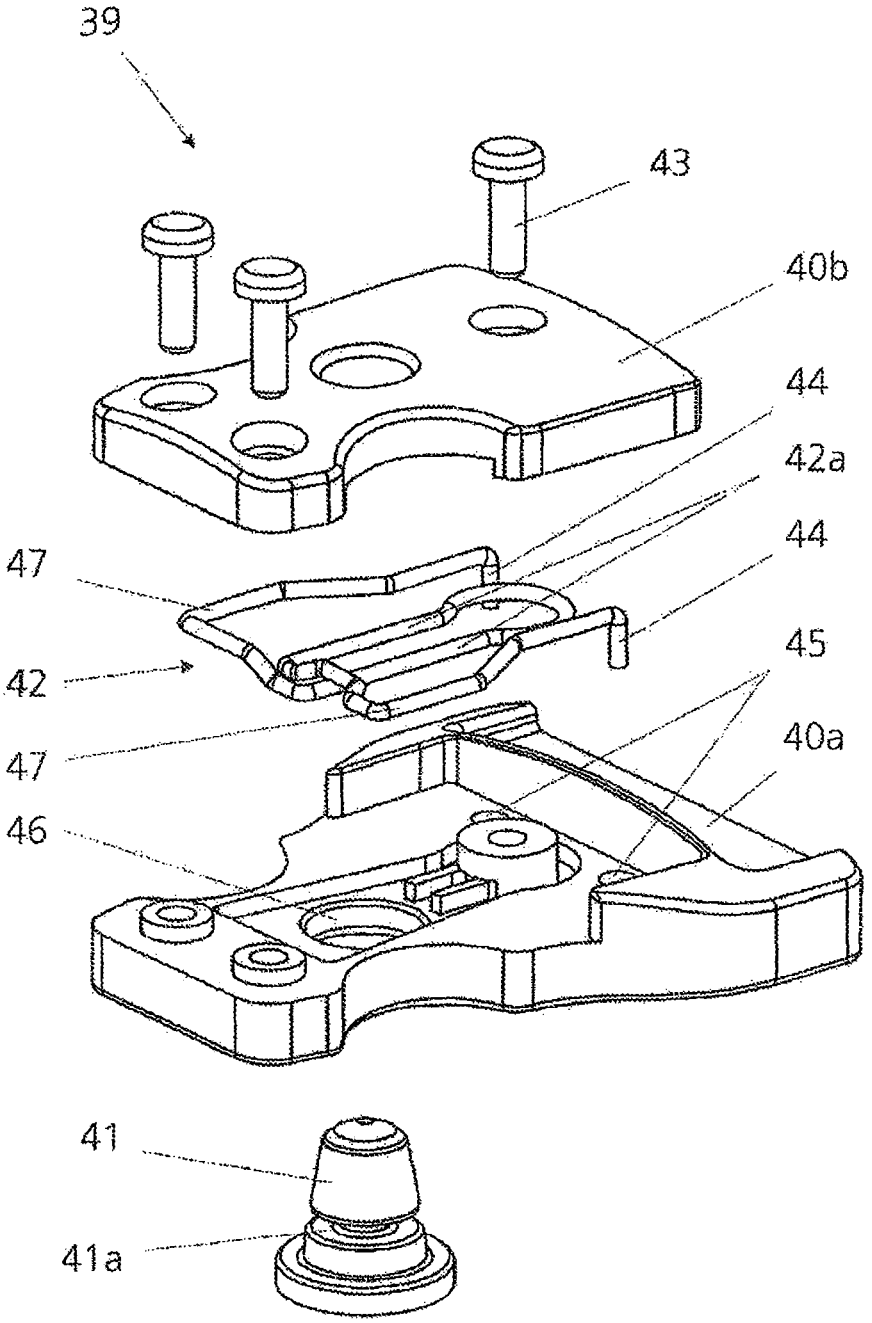
FIG. 13 is the rapid fastener illustrated in FIG. 12 for coupling the lateral support to a waist belt in a detailed illustration.

The specific design of the rapid release fastener 39 can be as desired. FIG. 13 shows a particular advantageous embodiment.

As is evident from FIG. 13, the rapid release fastener comprises a housing 40, which consists of two housing parts, which consist of a lower part 40*a* and an upper part 40*b*. The housing parts 40*a*, 40*b* can be connected to each other by attachment elements 43, in the exemplary embodiment by screws. The fastener part 42, in one embodiment in the form of a bent wire, is arranged between the lower part 40*a* and the upper part 40*b*. In this case the wire 42 is bent in such a manner that two preferably mutually parallel sections 42*a* are formed, which enclose the journal 41 on two opposite sides when the rapid release fastener 39 is locked to the journal 41. For this purpose, the journal 41 preferably comprises an annular circumferential groove 41*a* or a recess, as illustrated in FIG. 13. In the locked state, the sections 42*a* thus latch in the groove 41*a*. By compressing the sections 47 of the wire 42, the distance between the sections 42*a* increases, so that on reaching a defined distance the journal 41 can be pulled out of its locking position between the sections 42*a*. This is achieved by compressing together the two visible sections 42*a* illustrated in FIG. 12.

The wire 42 is further bent in such a manner that it comprises two end pieces 44, preferably bent at right angles, which can be inserted into corresponding receptacles 45 of the housing 40 (in the exemplary embodiment of the lower part 40*a* of the housing). The wire 42 is thus fixed relative to the housing 40 in a simple manner. Further, the housing 40 can comprise further formations that are adapted to the profile of the wire 42. In particular, it can be envisaged that a movement by which the sections 42*a* are moved towards each other is restricted by a suitably formed edge of the housing 40, in the exemplary embodiment an edge of the lower part 40*a*. As is further evident from FIG. 13, the wire 42 can comprise a section that forms a partial circle or a partial ring, which encloses a corresponding circular protrusion of the housing 42, in the exemplary embodiment the lower part 40*a*.

The rapid release fastener 39 illustrated in FIG. 13 is robust and particularly reliable in operation. With the rapid release fastener 39 it is possible to rapidly eject the carrying system or rapidly release it from the wearer when required. Further, the carrying system can be adjusted particularly well to persons of various sizes by means of the rapid release fastener, since the waist belts, which are available in various sizes, can easily be combined with lateral supports that are likewise available in various sizes.

The carrying system according to the invention is not restricted to the illustrated advantageous combination of various features. Rather, the features can even be combined with each other individually. Furthermore, the frame 26 and also the housing 11, as illustrated in FIG. 2, also constitute an invention independent of the carrying system.

The invention claimed is:

1. A carrying system with a ballistic protective vest, comprising:

a front part and a back part and a means of attaching to a person's upper body; a waist belt on which at least one lateral support is provided, and wherein the ballistic protective vest includes a coupling in order to releasably attach a carrying means to the rear side of the back part of the ballistic protective vest, and wherein at least two lateral supports are provided on the waist belt and can be attached to the carrying means, and wherein the carrying means is rotatably connected via the coupling to the ballistic protective vest, so that the carrying means is able to rotate at least within an angular range about an axis essentially extending perpendicular to the plane of the back part, and wherein a first remote triggering device is provided for opening the coupling in order to release the carrying means from the ballistic protective vest, and wherein the remote triggering device is mechanically connected to the coupling and extends in such a manner that an operating element of the remote triggering device is disposed above the upper side or in front of the front side of a person's upper body when the carrying system is being worn correctly, and wherein the two lateral supports lead from two opposite lateral parts of the waist belt to the carrying means and are attached thereto, and wherein the respective lateral supports comprises a first rod shaped supporting element, which leads from the waist belt to the carrying means, and a second rod-shaped supporting element which leads to the carrying means and which is attached to the carrying means in a vertically offset manner relative to the first rod-shaped supporting element.

2. The carrying system as claimed in claim 1, and wherein the end of the second supporting element which is remote from the carrying means is connected by a connecting element to the first supporting element and wherein the connecting element is axially movably attached to the first supporting element.

3. The carrying system as claimed in claim 1, and wherein the first supporting element is connected to the carrying means and/or to the waist belt so as to be pivotable about two axes.

4. The carrying system as claimed in claim 1, and wherein the second supporting element is connected to the carrying means so as to be pivotable about two axes.

5. The carrying system as claimed in claim 1, and wherein the first supporting element or the second supporting element is in the form of a rod/tube combination, so that the relative movement that a person generates between the hips and the upper body while walking leads to a movement of the rod in the tube, whereby the rod/tube combination is designed so that a movement of the rod in the tube generates an electric current.

6. The carrying system as claimed in claim 1, and wherein the lateral support is connected to the waist belt and/or to a connecting plate by means of a rapid release fastener.

7. The carrying system as claimed in claim 6, and wherein the waist belt and/or the connecting plate comprise a journal or a pin for coupling the rapid release fastener, which forms an axis of rotation for the rapid release fastener when the rapid release fastener is coupled.

8. The carrying system as claimed in claim 1, and wherein the carrying means comprises a first module, which is connected by the coupling to the ballistic protective vest.

9. The carrying system as claimed in claim 8, and wherein the first module comprises a coupling in order to releasably couple a second module to the rear side of the first module.

10. The carrying system as claimed in claim 9, and wherein the coupling for attaching the second module to the rear side of the first module consists of a spigot connection.

11. The carrying system as claimed in claim 9, and wherein the second module is torsionally rigidly connected to the first module.

12. The carrying system as claimed in claim 9, and wherein the second module comprises hook-shaped connecting elements, which can be suspended from pin-shaped connecting elements of the first module.

13. The carrying system as claimed in claim 9, and wherein the second module comprises a frame, which encloses the first module at its periphery at least partly in an interlocking manner.

14. The carrying system as claimed in claim 13, and wherein the frame comprises fastening eyelets.

15. The carrying system as claimed in claim 13, and wherein at least one backpack and/or at least one piece of luggage is/are attached to the frame.

16. The carrying system as claimed in claim 13, and wherein an essentially horizontally extending luggage holder is attached to the frame.

17. The carrying system as claimed in claim 13, and wherein an extension bracket is removably arranged on the upper side of the frame.

18. The carrying system as claimed in claim 9, and wherein a second remote triggering device is provided for opening the coupling between the first module and the second module, in order to release the second module from the first module.

19. The carrying system as claimed in claim 18, and wherein the second remote triggering device is mechanically connected to the coupling and extends in such a manner that an operating element of the second remote triggering device is disposed above the upper side of or in front of the front side of a person's body when the carrying system is being worn correctly.

20. The carrying system as claimed in claim 8, and wherein the first module is a housing, in which electronic components and/or electronic devices are accommodated.

21. The carrying system as claimed in claim 9, and wherein coupling parts of the second module, which are designed for coupling to the coupling of the first module, are also designed for coupling to the coupling of the ballistic protective vest.

22. The carrying system as claimed in claim 9 and wherein the second module comprises coupling parts for connecting to the coupling of the first module and coupling parts that are different from these for connecting to the coupling of the ballistic protective vest, whereby the second module comprises a receptacle, in which the respectively required coupling part can be inserted.

23. The carrying system as claimed in claim 9, and wherein the second module comprises receiving elements, to which the lateral supports that are connected to the waist belt can be attached.

24. The carrying system as claimed in claim 9, and wherein the first module consists of a frame for attaching at least one backpack and/or at least one piece of luggage.

25. The carrying system as claimed in claim 1, and wherein the ballistic protective vest is of soft ballistic form at the front part and/or at the back part.

26. The carrying system as claimed in claim 1, and wherein the ballistic protective vest is provided with hard ballistic inserts at its front part and/or at its back part.

27. The carrying system as claimed in claim 1 and further having a frame for carrying loads.

28. The carrying system as claimed in claim 1 and further having a housing with an interior, in which electronic components and/or electronic devices are arranged, for use as a first module for the carrying system.

* * * * *